US005171167A

United States Patent [19]

Kosmala

[11] Patent Number: 5,171,167

[45] Date of Patent: Dec. 15, 1992

[54] CONNECTOR WITH RESILIENT INTERSHELL CONNECTION

[75] Inventor: Michael L. Kosmala, Costa Mesa, Calif.

[73] Assignee: ITT Corporation, Secaucus, N.J.

[21] Appl. No.: 865,539

[22] Filed: Apr. 9, 1992

[51] Int. Cl.[5] ..... H01R 13/648

[52] U.S. Cl. ..... 439/607; 439/95

[58] Field of Search ..... 439/607-610, 439/95, 108, 906

[56] References Cited

U.S. PATENT DOCUMENTS

| | | | |
|---|---|---|---|
| 4,500,159 | 2/1985 | Briones et al. | 339/147 |
| 4,516,815 | 5/1987 | Venable et al. | 439/607 |
| 4,689,723 | 8/1987 | Mayers et al. | 439/607 |
| 4,708,412 | 2/1987 | Himes, Jr. et al. | 439/95 |
| 4,718,866 | 1/1988 | Yamaguchi | 439/607 |
| 4,786,260 | 11/1988 | Spauding | 439/607 |
| 4,808,125 | 2/1989 | Waters et al. | 439/607 |
| 4,822,303 | 4/1989 | Nakamura et al. | 439/607 |
| 4,854,890 | 8/1989 | Nishimura | 439/607 |
| 4,874,336 | 10/1989 | Marsh | 439/607 |
| 4,902,242 | 2/1990 | Davis et al. | 439/404 |
| 4,906,208 | 3/1990 | Nakamura et al. | 439/607 |
| 4,938,704 | 7/1990 | Fujiura | 439/607 |
| 4,959,024 | 9/1990 | Czeschka | 439/607 |
| 5,055,070 | 10/1991 | Plegge et al. | 439/609 |

*Primary Examiner*—Larry I. Schwartz
*Assistant Examiner*—Hien D. Vu
*Attorney, Agent, or Firm*—Thomas L. Peterson

[57] ABSTRACT

A connector is provided which includes a screw-connected two-peice housing (22, FIG. 2) that surrounds an insulator-holding sheet metal shell (20), which resists loosening of the screws that hold the housing parts in ground connection with the shell. Each side of the insulator has three protuberances (81-83) which press outwardly against a corresponding side (76) of the shell, and each housing part has a pair of protuberances (94, 95) that press inwardly against a corresponding side of the shell. The protuberances on the insulator and housing parts are spaced to deflect each side of the wall into a largely sinusoidal shape (74 in FIG. 6), so the deflected shell sides act like leaf springs that press the housing parts apart to prevent screw loosening and assure good grounding connection between the shell and housing.

10 Claims, 4 Drawing Sheets

FIG. 7
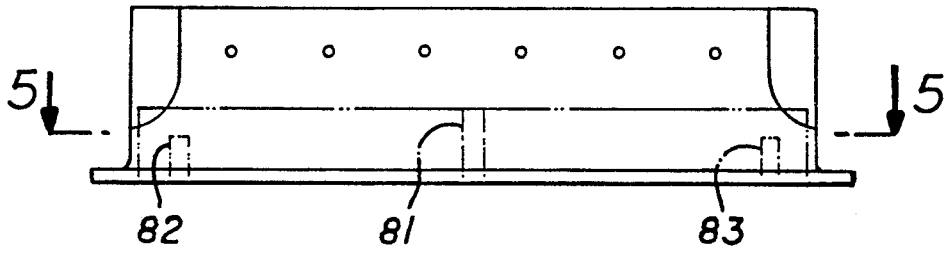
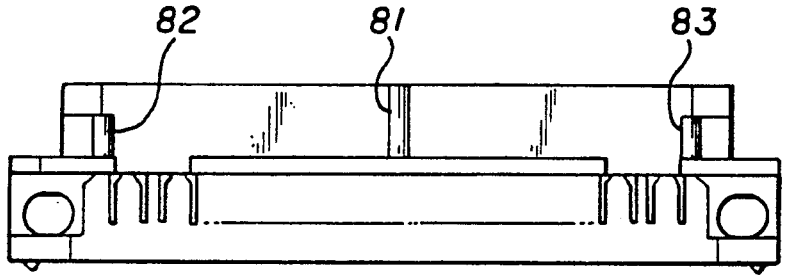
FIG. 8
FIG. 9
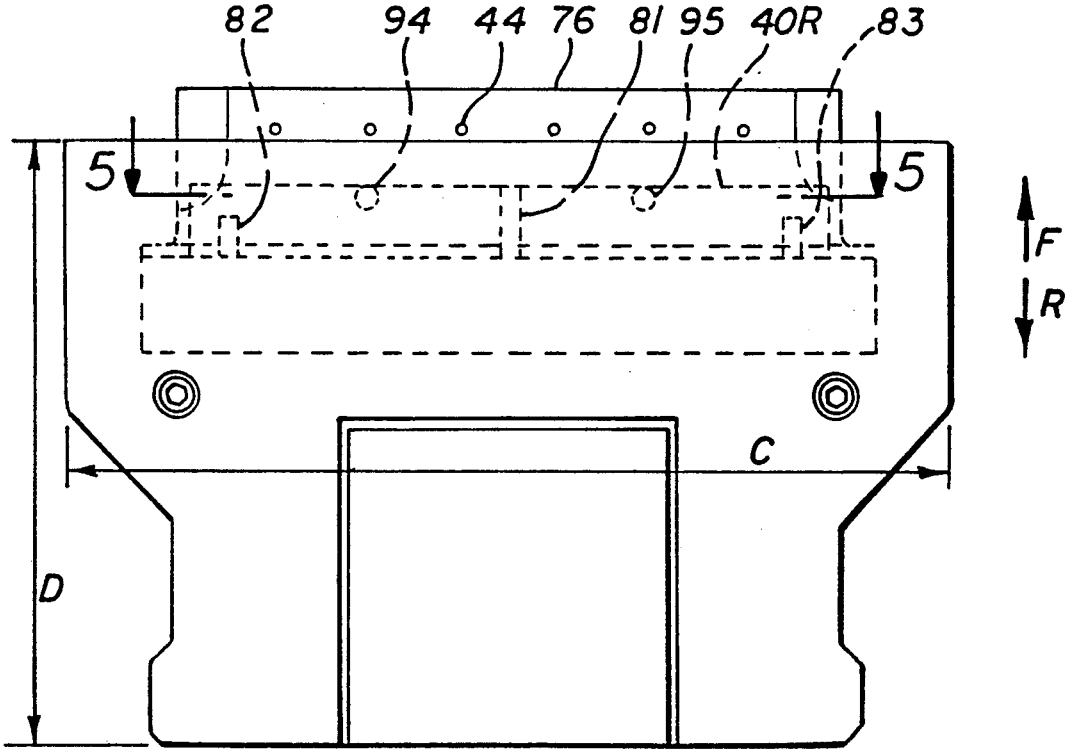

CONNECTOR WITH RESILIENT INTERSHELL CONNECTION

BACKGROUND OF THE INVENTION

One type of connector includes a sheet metal plug shell, or shell, which surrounds the front end of an insulator containing rows of contacts. The shell is surrounded by a cast metal backshell, or housing, formed in two parts which are screwed together around the shell. The housing must make good electrical grounding connection with the shell to provide electromagnetic shielding and controlled impedance for wires extending from the end of a cable projecting into the housing. If the screws should loosen as a result of vibrations, thermal cycling, shock, etc. then the housing parts can separate slightly and lose contact with the shell, resulting in the housing not being grounded. A connector construction which helped lock the screws in their fully tightened position, assured good electrical connection between the housing and shell, and held the shell in a precise position around the insulator to assure precision mating of contacts, would be of considerable value.

SUMMARY OF THE INVENTION

In accordance with one embodiment of the present invention, a connector is provided of the type that includes a sheet metal shell that holds an insulator and that lies between a two-piece conductive housing, which provides resilient compressive connection between the housing and shell to resist loosening of fasteners that hold the housing parts together. The insulator has at least one outwardly-projecting protrusion that engages one side of the sheet metal shell. A side of the housing has an inwardly-projecting protuberance that engages the opposite face of the same side of the shell at a location longitudinally spaced from the insulator protuberance. The parts are constructed so the protuberances deflect the shell side into a largely sinusoidal or a wave-like curve that results in the shell side forming a leaf spring that resiliently biases the shell parts apart to resist loosening of the fasteners that hold the shell parts together.

The insulator can have three protuberances at each side, with two protuberances at each end of the insulator serving to precisely locate the shell with respect to the insulator when the shell sides are deflected inwardly. In that case, each housing part can have a pair of protuberances that each lie on opposite sides of the middle insulator protuberance to stably locate the shell with respect to the housing as well as the insulator. With a front portion of the shell forming a cavity lying in front of the front end of the insulator, the protuberances preferably lie rearward of the cavity.

The novel features of the invention are set forth with particularity in the appended claims. The invention will be best understood from the following description when read in conjunction with the accompanying drawings.

BRIEF DESCRIPTION OF THE DRAWINGS

FIG. 7 is an elevation view of the shell of the connector of FIG. 2.

FIG. 8 is a side elevation view of the insulator of the connector of FIG. 2.

FIG. 9 is a side elevation view of the assembled connector of FIG. 1.

DESCRIPTION OF THE PREFERRED EMBODIMENT

Figure 1:
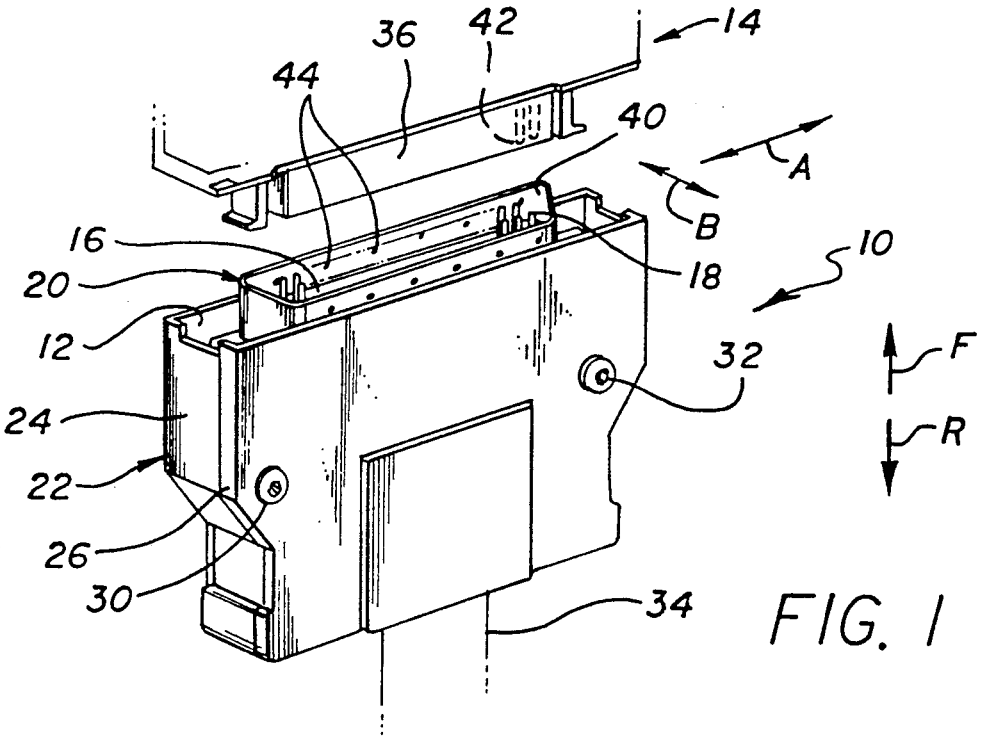
FIG. 1 is an isometric view of a connector constructed in accordance with the present invention, and showing part of a mating connector device.

FIG. 1 illustrates a connector 10 which has a mating front end 12 for mating with a connector device 14. The connector 10 includes an insulator 16 that contains two rows of contacts 18, a shell 20 which surrounds a front portion of the insulator, and a housing 22 that surrounds much of the shell and insulator. The housing includes two cast metal halves or parts 24, 26 which are held together by a pair of screws 30, 32. The connector is normally fastened to the front end of a cable 34 which has multiple wires each connected to one of the contacts 18.

The connector can move in forward and rearward directions indicated by arrows F, R to mate and unmate from the connector device 14. The connector is elongated in a longitudinal direction A, and the contacts 18 extend in a pair of rows along the longitudinal direction A which is perpendicular to a lateral direction B. When the connector and connector device 10, 14 mate, a shell device 36 on the mating connector device enters a cavity 40 at the front end of the shell 20, resulting in the contacts 18 of the connector engaging corresponding contact devices 42. The shell 20 has inwardly-protruding bumps 44 surrounding the cavity 40, which press against the shell device 36 to provide good electrical connection between them. It may be noted that the shell 20 is sometimes referred to in the industry as a plug shell, while the housing 22 is sometimes referred to as a backshell because it extends rearward or backward to surround a stripped forward portion of the cable.

Figure 2:
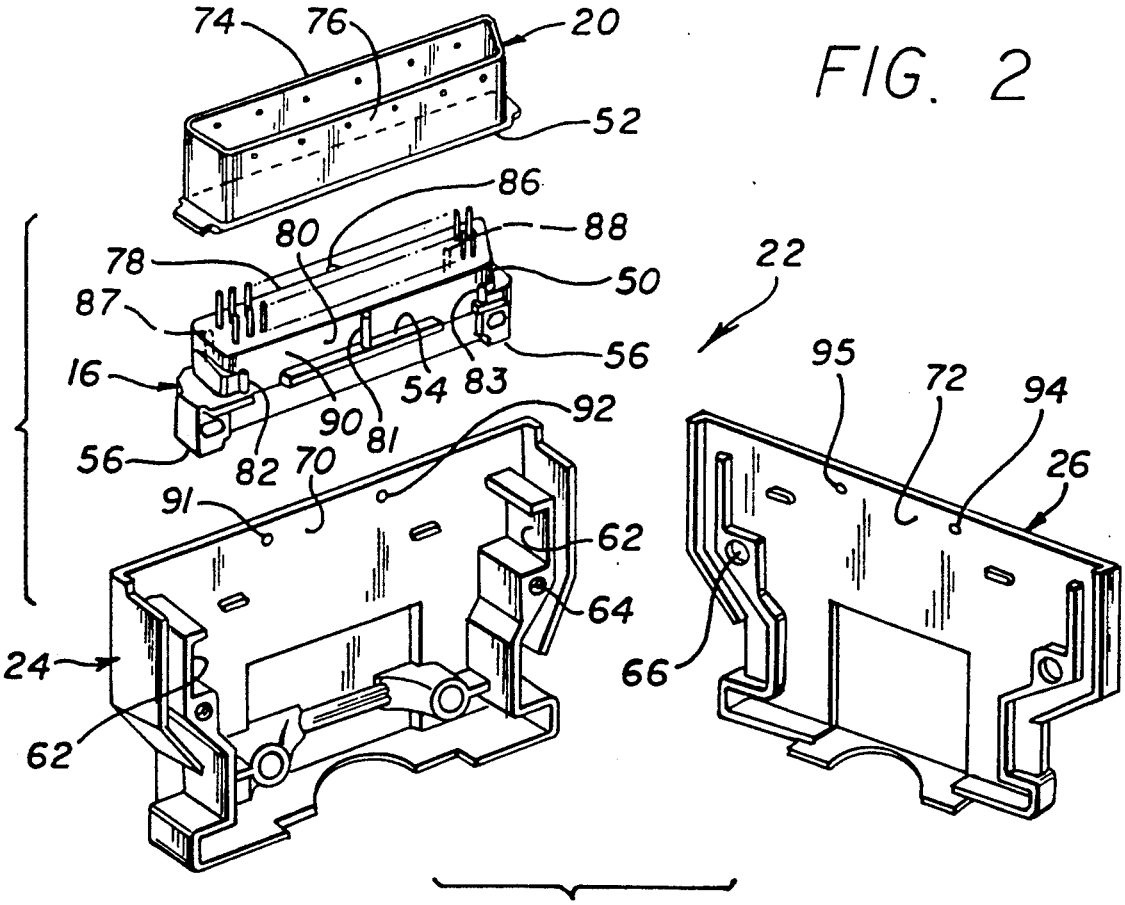
FIG. 2 is an exploded isometric view of the connector of FIG. 1.
Figure 3:
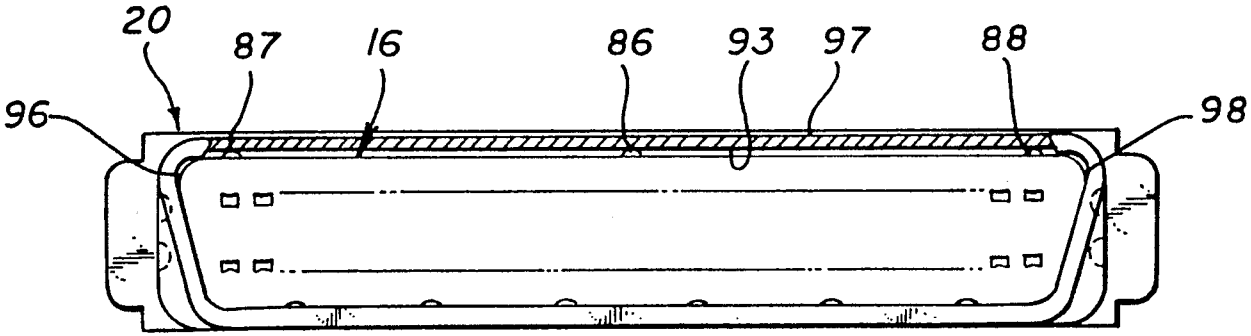
FIG. 3 is a plan view of the assembled insulator and shell of the connector of FIG. 2.

As indicated in FIG. 2, the connector can be assembled by first inserting a front portion 50 of the insulator 16 into a rear portion of the shell 20, until a flange 52 at the rear of the shell abuts a shoulder 54 on the insulator. Then, the combination of shell and insulator is inserted into the first housing part 24 by inserting ears 56 at the rear portion 60 of the insulator, into recesses 62 formed in the first housing part. Next, the second housing part 26 is aligned with the first housing part, and the screws are inserted through holes 64, 66 in the housing parts to hold them together. The holes 64 in the first housing part are threaded. As the screws are tightened, shell-engaging faces 70, 72 of the housing parts must securely engage laterally-spaced first and second sides 74, 76 of the shell 20. Such engagement is important to assure good electrical connection between the electrically grounded shell 20 and the housing 22. It is important that the housing 22 be grounded, so that it can provide electromagnetic shielding and controlled impedance for the wires at the stripped front end of the cable which lie within the housing.

One source of problem that arises in the use of connectors of the general type illustrated, is that the screws can become loosened as a result of vibration, thermal and mechanical shock, etc. Even slight loosening can result in slight separation of the housing parts, resulting in their surfaces 70, 72 breaking electrical contact with the shell sides 74, 76. Also, the parts had to be made with high precision to assure contact between the shell and housing even when the screws were tightened. In accordance with the present invention, the shell sides 74, 76 are utilized in the manner of deflected leaf springs, to provide a spring effect that resiliently urges the housing parts 24, 26 apart, to resist loosening of the screws and assure good shell-to-housing contact. The shell 20 is formed of sheet metal or any equivalent material which results in the shell sides being electrically conductive and resiliently bendable.

The insulator has first and second shell engaging faces 78, 80 which lie adjacent to corresponding shell sides 74, 76. The second insulator face 80 has three protuberances 81–83 that engage the corresponding shell side 76. Similarly, the first insulator face 78 has three protuberances 86, 87, 88 which engage the corresponding shell side 74. The three longitudinally-spaced protuberances such as 81–83 on an insulator face leave spaces such as 90 into which the shell side such as 76 can be deflected. Such deflection is produced by protuberances on the housing. The first housing part 24 has first and second protuberances 91, 92, while the second housing part 26 has two corresponding protuberances 94, 95.

Figure 4:
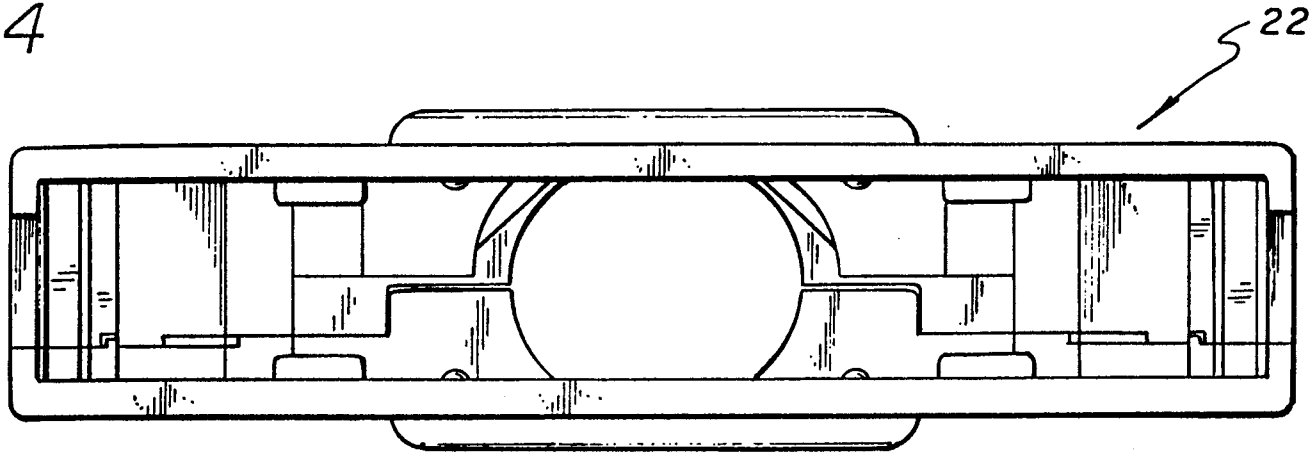
FIG. 4 is a plan view of the housing of the connector of FIG. 2.
Figure 5:
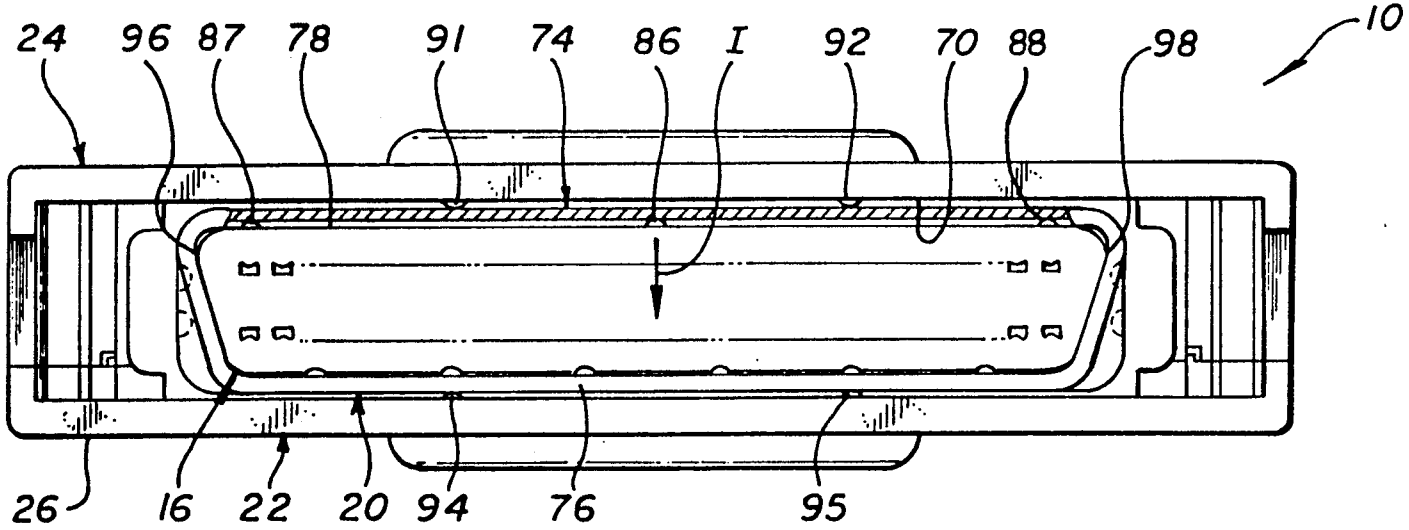
FIG. 5 is a plan view of the insulator and shell of FIG. 3 assembled with the housing of FIG. 4.
Figure 6:
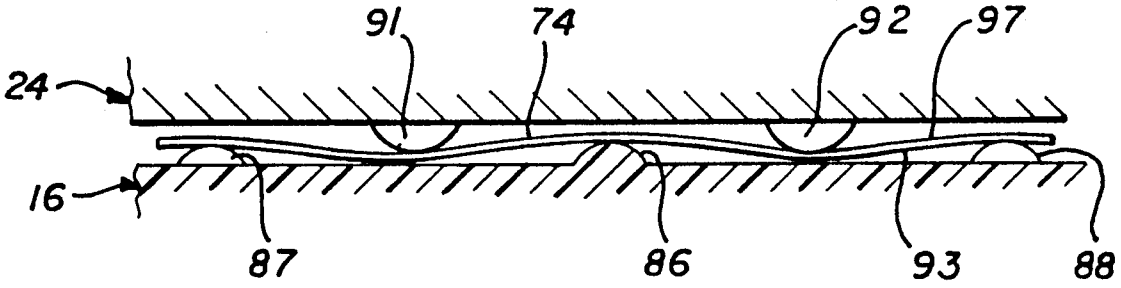
FIG. 6 is an exaggerated view of a portion of FIG. 5, showing deflection of one side of the shell.

FIG. 5 shows a fully assembled connector 10, and shows the manner in which one of the shell sides 74 is bowed. The shell side is deflected into a wave of largely sinusoidal shape by the protuberances 86–88 on the first face 78 of the insulator 16, and by the pair of protuberances 91, 92 on the first shell-engaging face 70 of the first housing part 24. The first shell side 74 is shown in section, as taken along the line 5—5 of FIG. 7, at the level of the middle insulator protuberances 81 and 86. While the insulator protuberances 86–88 support the shell side 74 against inward movement in the inward lateral direction I, the housing protuberances 91–92 press inwardly against the shell side to deflect it in the inward direction I. FIG. 6 is an exaggerated view of the shell side 74, showing how it is deflected into a largely sinusoidal curve by the protuberance 86 (and somewhat also by protuberances 87 and 88) on the insulator that engage the inner face 93 of the shell side and the opposed protuberances 91–92 on the housing that engage the outer face 97 of the shell side. The protuberances of FIG. 6 are shown four times the size shown in FIG. 4, resulting in an exaggerated view of the deflection of the shell side 74.

The shell side 74 acts like a leaf spring, which is long and thin and resists beam-like bending, to urge the housing parts 24, 26 away from each other. The shell sides 74, 76 are deflected in the manner of a leaf spring only as the screws that join the housing parts 24, 26 approach a fully tightened state. The deflection of the shell sides provide resistance against perhaps the last 90° of turning of each screw. With the screw fully tightened, the deflected sides of the sheet metal shell provide resistance to loosening of the screws in the event of vibrations, thermal cycling, shocks, etc., which could loosen a screw which is not held against loosening. The fact that engagement of the housing 22 with the shell 20 occurs at the tips of the housing protuberances 91–92 and 94–95, results in known contact forces applied over the small areas of the four protuberances. The resulting high pressure contact results in reliable low resistance contact between the housing and shell. Applicant prefers to place two of the insulator protuberances such as 87 and 88 on each insulator side, adjacent to the opposite ends 96, 98 of the insulator. This results in the protuberances 87, 88 serving to precisely locate the insulator 16 with respect to the shell, which is important because the shells of mating connectors determine the initial positions of the mating contacts. The protuberances such as 87, 88 preferably lie within about ten per cent of the extreme ends 96, 98 of the front insulator portion which is received in the shell.

It is noted that the height or forward position of the protuberances such as 94, 95 in FIG. 9, is no forward than the rear 40R of the shell cavity. Also, the center insulator protuberance 81 extends about as far forward as the housing protuberances 94, 95, but the other insulator protuberances 82, 83 do not extend as far forward. This results in most of the deflection of the shell side occurring between the two housing protuberances 94, 95. Applicant deflects primarily the rearward portion of the shell side, while leaving the forward portion that forms the cavity largely undeflected so it can reliably receive the shell of the mating connector device.

Applicant has constructed a connector of the type shown, wherein the connector had an overall width C of 1.93 inch (49 mm) and height D of 1.3 inch (33 mm). The housing had a thickness of about fifty thousandths inch (1.3 mm) at most locations, while the shell was formed of deformed sheet metal with its sides having a thickness of about twenty thousandths inch thickness (0.5 mm). The relative dimensions of the parts are shown in the figures (except for FIG. 6). Screws of size 2–56 (56 threads per inch) were used, and it was found that a substantial increase in resistance to turning occurred during the last approximately 90° of screw turning. This is compared to a similar prior art connector of similar construction, but without the protuberances that bend the shell sides like a leaf spring, which provided a rapid increase in resistance during only about the last 10° of screw turning.

Thus, the invention provides a connector of the type that includes a contact-holding insulator within a sheet metal shell, which is in turn held within a housing having at least two halves or parts that must be fastened together as with screws, which provides resistance to loosening of the fasteners while also providing reliable low resistance contact between the housing and shell. This is accomplished by providing protuberances on the insulator and housing which engage longitudinally-space locations on each shell side to deflect the side as the shells become fully tightened. The deflected sheet metal shell sides act like bent leaf springs to provide resilience that resist loosening of the springs, and also result in reliable low resistance contact between the housing and shell at the housing protuberances. It is possible to use only a single housing protuberance and a single insulator protuberance against a side of the shell, although applicant prefers to provide at least two protuberances on one element (insulator or housing part) that engages one face of the shell side, and a protuberance on the other element that engages the other face of the shell side.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector that has a mating front end, and that includes an insulator containing multiple contacts arranged in at least one longitudinally extending row, a sheet metal-like shell surrounding a front portion of said insulator and having first and second opposite shell sides, and a conductive housing which surrounds said shell and insulator, wherein said housing has first and second parts and at least one fastener that can press first and second shell-engaging faces of said housing toward each other to firmly engage said first and second sides of said shell to securely electrically connect said housing and shell, characterized by:

said insulator has first and second opposite shell-engaging faces lying adjacent respectively to said first and second sides of said shell and facing said first and second shell-engaging faces of said housing;

said first shell-engaging face of said insulator has at least two longitudinally-spaced protuberances which engage said first shell side, and said first shell-engaging face of said housing has a protuberance which lies longitudinally between said two protuberances on said first shell-engaging face of said insulator, to bow said first side of said shell.

2. The connector described in claim 1 wherein:

said housing forms said one of said first shell-engaging faces which has at least two longitudinally-spaced protuberances and said insulator forms said other of first shell-engaging faces.

3. The connector described in claim 1 wherein:

said insulator forms said one of said shell-engaging faces, and said insulator protuberance is in the form of an elongated ridge that extends in a front-to-rear direction.

4. The connector described in claim 1 wherein:

said insulator forms said one of said first shell-engaging faces and includes three longitudinally spaced protuberances including said two protuberances, with said insulator front portion having opposite longitudinally-spaced ends and with two of said protuberances on said insulator lying adjacent to said opposite ends of said front portion;

said housing forms said other of said first shell-engaging faces and includes two longitudinally spaced protuberances each lying about halfway between two of said insulator protuberances.

5. The connector described in claim 1 wherein:

said shell has front and rear portions, said front portion has a plurality of inwardly-projecting bumps for engaging the shell of a mating connector device, and said protuberances engage substantially only said rear portion of said shell.

6. The connector described in claim 1 wherein:

said housing has longitudinally spaced ends, and said fastener comprises two longitudinally spaced screws.

said housing forms said one of said shell-engaging faces which has at least two longitudinally-spaced protuberances, and said housing second face also has at least two longitudinally spaced protuberances;

said insulator forms said other of said first shell-engaging faces, and said insulator second face also has at least one protuberance which lies longitudinally between said protuberances on said housing second face.

7. A method for use with a connector that has a mating front end, an insulator having opposite sides and containing multiple contacts arranged in at least one longitudinally-extending row, a sheet metal shell surrounding a front portion of said insulator and having first and second opposite sides, and an outer conductive housing which surrounds said shell and insulator and which has first and second parts, wherein said method provides a way to securely fasten said housing parts together, characterized by:

projecting a pair of screws into said housing parts and tightening said screws to hold said housing parts together;

establishing said insulator with at least one protrusion on each of said sides, and establishing each of said housing parts with a pair of longitudinally-spaced protuberances lying longitudinally on opposite sides of said insulator protuberances;

tightening said screws to move said housing parts toward each other and to press each of said housing part protuberances into one of said shell sides to deflect it inwardly, while supporting a location on each of said shell sides lying longitudinally between said housing part protuberances with one of said insulator protuberances, to deflect each of said shell sides into a largely sine-wave curve.

8. A connector comprising:

an insulator which holds a plurality of contacts, which has forward and rearward parts, which is elongated in a predetermined longitudinal direction, and which has opposite insulator faces spaced in a lateral direction that is perpendicular to said longitudinal direction;

a sheet metal shell which surrounds said forward end of said insulator and which has first and second shell sides lying adjacent respectively to said first and second insulator sides;

a housing which includes first and second housing parts that surround at least portions of said shell and insulator and that form first and second housing faces that lie respectively adjacent to said first and second shell sides, said housing parts having aligned screw-receiving holes;

a pair of screws which lie in said holes and hold said housing parts in abutment;

said faces of said insulator and of said housing have protrusions protruding toward each of said shell sides, with each insulator protrusion at an insulator face being longitudinally spaced from a housing protrusion lying at a corresponding housing face, with said protrusions positioned close enough to a corresponding side at said shell to bow the corresponding side of said shell when said housing parts abut each other, so progressive tightening of said screws causes progressively greater bowing of said shell sides to resist screw tightening and therefore also screw loosening.

9. The connector described in claim 8 wherein:

said insulator has at least two elongated ridges extending in a forward-rearward direction on each of said insulator sides, said ridges forming at least some of said insulator protrusions, and each of said housing sides has at least one protrusion lying longitudinally between said two ridges on a corresponding insulator side.

10. The connector described in claim 8 wherein:

said insulator front end lies rearward of shell front end, to leave a shell front cavity; and including a mating connector device which includes a mating insulator device that has a plurality of contact devices and that fits into said shell cavity, said mating connector device also having a mating shell device that closely interfits with substantially only the walls of said cavity;

said protuberances on said housing and insulator lie rearward of said cavity.

* * * * *